US005676756A

United States Patent [19]

Murate et al.

[11] Patent Number: 5,676,756

[45] Date of Patent: Oct. 14, 1997

[54] ROTARY ATOMIZING ELECTROSTATIC COATING APPARATUS AND A METHOD OF USE THEREOF

[75] Inventors: Masashi Murate, Nagoya; Isamu Yamasaki; Ichio Tomita, both of Toyota, all of Japan

[73] Assignee: Toyota Jidosha Kabushiki Kaisha, Toyota, Japan

[21] Appl. No.: 514,062

[22] Filed: Aug. 11, 1995

Related U.S. Application Data

[63] Continuation of Ser. No. 117,670, Sep. 8, 1993, abandoned.

[30] Foreign Application Priority Data

Sep. 11, 1992 [JP] Japan ..... 4-242829
Apr. 28, 1993 [JP] Japan ..... 5-102872

[51] Int. Cl.[6] ..... B05B 3/10

[52] U.S. Cl. ..... 118/629; 118/302; 118/626; 239/106; 239/113; 239/223; 239/706

[58] Field of Search ..... 118/300, 302, 118/626, 629; 239/104, 106, 110, 113, 119, 120, 223, 224, 700, 703, 706, 707

[56] References Cited

U.S. PATENT DOCUMENTS

| | | | |
|---|---|---|---|
| 1,941,453 | 1/1934 | Whittington . | |
| 2,057,925 | 10/1936 | Smith . | |
| 2,686,562 | 8/1954 | MacCracken . | |
| 3,106,226 | 10/1963 | Machen . | |
| 3,135,994 | 6/1964 | Skinner . | |
| 3,188,048 | 6/1965 | Sutherland . | |
| 3,504,851 | 4/1970 | Demeter . | |
| 4,145,025 | 3/1979 | Bergeron . | |
| 4,489,756 | 12/1984 | Balz . | |
| 4,597,719 | 7/1986 | Tano . | |
| 4,760,965 | 8/1988 | Schneider . | |
| 4,776,520 | 10/1988 | Merritt | 239/700 |
| 4,785,995 | 11/1988 | Yamane et al. . | |
| 4,881,563 | 11/1989 | Christian . | |
| 4,887,770 | 12/1989 | Wacker et al. | 239/703 |
| 4,943,005 | 7/1990 | Weinstein | 239/703 X |
| 5,027,919 | 7/1991 | Silva . | |
| 5,039,019 | 8/1991 | Weinstein et al. | 239/691 |
| 5,078,321 | 1/1992 | Davis et al. | 239/703 X |
| 5,092,362 | 3/1992 | Yie . | |
| 5,100,057 | 3/1992 | Wacker . | |
| 5,156,336 | 10/1992 | Hammond et al. | 239/214.25 |
| 5,208,078 | 5/1993 | Ishibashi et al. | 239/112 X |
| 5,271,569 | 12/1993 | Konieczynski et al. | 239/112 X |

FOREIGN PATENT DOCUMENTS

| | | |
|---|---|---|
| 0109224 | 5/1984 | European Pat. Off. . |
| 0508771 | 10/1992 | European Pat. Off. . |
| 823859 | 1/1938 | France . |
| 74260 | 11/1960 | France . |
| 1343747 | 10/1963 | France . |
| 3616684 | 11/1987 | Germany . |
| 3912700 | 11/1990 | Germany . |
| 2133447 | 11/1990 | Japan . |
| 3 19548 | 2/1991 | Japan . |
| 3 90646 | 9/1991 | Japan . |
| 940679 | 10/1963 | United Kingdom . |
| 2105837 | 5/1984 | United Kingdom . |

*Primary Examiner*—James Engel
*Attorney, Agent, or Firm*—Cushman, Darby & Cushman, IP Group of Pillsbury, Madison & Sutro LLP

[57] ABSTRACT

A rotary atomizing electrostatic coating apparatus includes a plurality of paint nozzles and a solvent nozzle. Each paint nozzle communicates uniquely with a respective paint source separate by respective paint passages which are pathwise separate from each other. In each paint passage, a respective paint valve is installed. When changing a painting color according to the present invention, the paint filling the operating paint nozzle and the paint passage connected thereto is not washed out by a washing solvent, so that the amount of paint wasted when changing the painting color is decreased to substantially zero and the working time period for changing the painting color is also shortened. A corresponding method of use of such an apparatus is also disclosed which reduces the amount of paint wasted and the amount of solvent used during a step of switching from a first paint to a second paint.

78 Claims, 5 Drawing Sheets

ROTARY ATOMIZING ELECTROSTATIC COATING APPARATUS AND A METHOD OF USE THEREOF

This is a continuation of application Ser. No. 08/117,670, filed on Sep. 8, 1993, which was abandoned upon the filing hereof.

BACKGROUND OF THE INVENTION

1. Field of the Invention

The present invention relates to a rotary atomizing electrostatic coating apparatus wherein the amount of paint wasted at the time of changing a painting color is decreased to substantially zero.

2. Description of Related Art

As disclosed in Japanese Utility Model Publications HEI 2-133447, HEI 3-19548, and HEI 3-90646, a conventional rotatry atomizing electrostatic coating apparatus includes a spray gun having a single paint nozzle for supplying a paint to an atomizing head of the spray gun. The paint nozzle is connected, via a single hose having a length of about two meters, to a manifold to which a plurality of paint circulation pipes, a washing solvent (thinner) supply pipe and a washing air supply pipe are connected. In each paint circulation pipe, a paint feed pump and a color change valve (an air-actuated stop valve) are installed.

When the painting color is changed, the operating color change valve is closed so that any paint supply is stopped. Then, to prevent colors from mixing, a washing solvent, which is usually a paint thinner, is supplied to the manifold so that the paint in the manifold and in the hose is washed out to a solvent receiving tank together with the solvent. The solvent remaining in the manifold and the hose is then blown out to the tank by a washing air. Then, a spray gun washing solvent is supplied to the spray gun to wash the paint adhering to the surface of a rotary atomizing head of the spray gun. After the washing, another paint color change valve is opened and the next painting process starts with a new paint color.

However, in each conventional paint color changing process, as much as about 50 cc of paint in the manifold, the hose, and the spray gun is wasted, and about 100 cc of solvent for washing out the paint is consumed, which results in an increase in the painting cost and an increase in the time period needed for changing the painting color.

SUMMARY OF THE INVENTION

An object of the invention is to provide a rotary atomizing electrostatic coating apparatus and method capable of decreasing an amount of paint wasted at the time of changing a painting color and decreasing a time period needed for changing the painting color.

A rotary atomizing electrostatic coating apparatus in accordance with the present invention includes a plurality of paint nozzles which communicate with respective paint sources via different paint passages. Each paint nozzle and the paint passage connected thereto are used for supply of a paint of a respective color only. Therefore, it is not necessary to wash out the paint filling the paint nozzle and the hose connected thereto when changing the painting color. According to the method of the present invention, all that is necessary at the time of paint color changing is to wash the paint adhering to the atomizing head. As a result, the amount of paint wasted at the time of paint color changing is decreased to substantially zero. Since it is not necessary to wash interiors of the paint nozzle and the hose, the amount of solvent used in the paint color changing is decreased and the time period for changing paints is also shortened.

BRIEF DESCRIPTION OF THE DRAWINGS

The above and other objects, features, and advantages of the present invention will become apparent and will be more readily appreciated from the following detailed description of the preferred embodiments of the invention taken in conjunction with the accompanying drawings, in which.

DETAILED DESCRIPTION OF THE PREFERRED EMBODIMENTS

Figure 1:
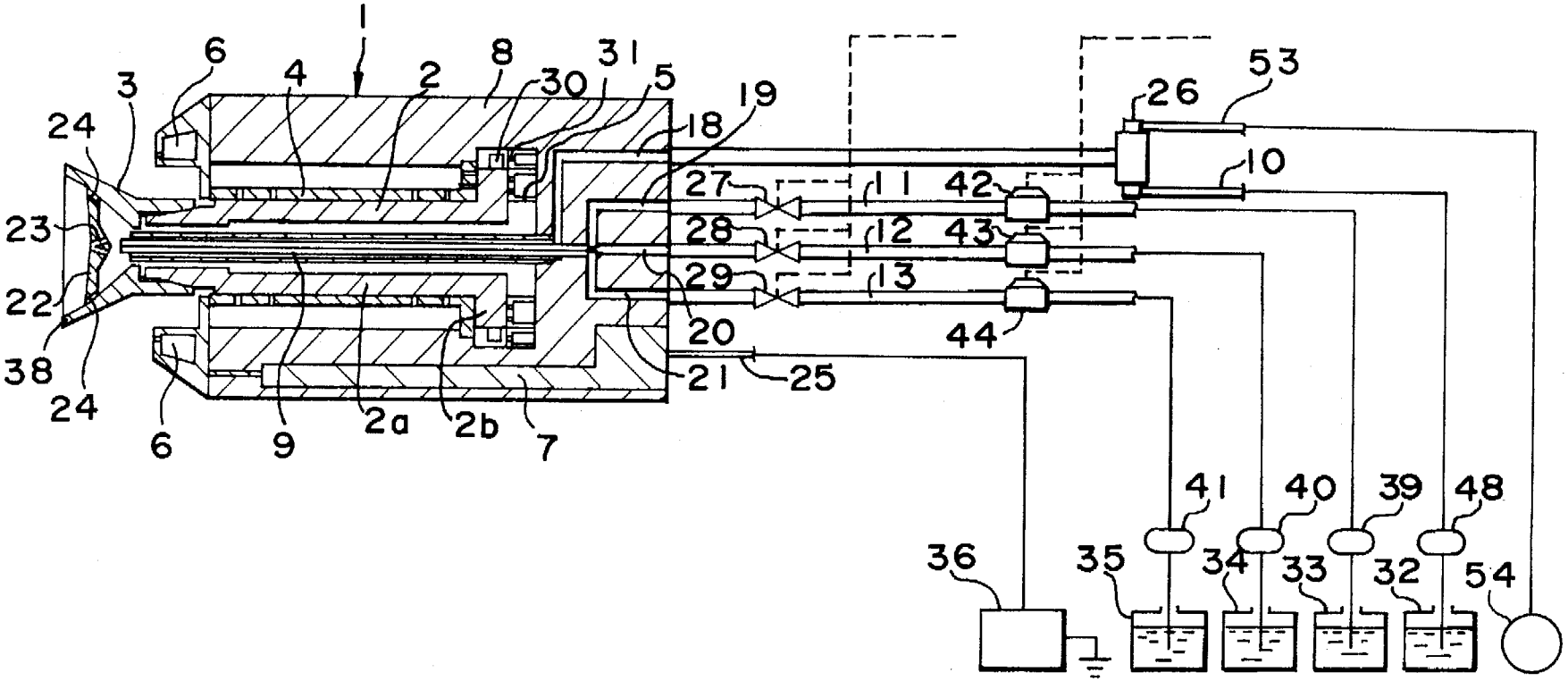
FIG. 1 is a cross-sectional view of a rotary atomizing electrostatic coating apparatus in accordance with a first or second embodiment of the present invention.

Four embodiments of the invention will be explained below. Throughout all the embodiments, the same structural portions are denoted with the same reference numerals, and the reference numerals denoting the portions unique to second, third, and fourth embodiments are suffixed with A, B, and C, respectively.

As illustrated in FIG. 1, a rotary atomizing electrostatic coating apparatus 1 of a first embodiment of the invention has a body 8, a hollow shaft 2, a radial bearing 4, a thrust bearing 5, an atomizing head 3, an air motor for driving the atomizing head 30, 31, a nozzle assembly 9, an electrostatic high voltage generating device 7, and a paint spray shaping air injection device 6.

The body 8 is a static member and is constructed of an electrically non-conductive material, (for example, a synthetic resin). The body 8 is generally cylindrical and has an axially extending cylindrical recess therein. The hollow shaft 2 is housed in the cylindrical recess of the body 8 and is rotatably supported by and lies coaxially with the body 8 via a radial bearing 4 and a thrust bearing 5 which are typically air bearings. The hollow shaft 2 has a cylindrical portion 2*a*, and a flange portion 2*b* towards a rear end of the cylindrical portion. The hollow shaft 2 is supported by the radial bearing 4 at the cylindrical portion 2*a* and by the thrust bearing 5 at the flange portion 2*b*. The hollow shaft 2 is rotatably driven by an air motor which comprises a plurality of turbine blades 30 fixed to an outside surface of the flange portion 2b of the hollow shaft 2 and air injection nozzles 31 for injecting air against the turbine blades 30 so that the hollow shaft 2 is rotated about an axis of the apparatus 1. The atomizing head 3 is coupled to the hollow shaft 2 so as to rotate together with the hollow shaft 2. The atomizing head 3 and the hollow shaft 2 are coaxial with each other. The atomizing head 3 and the hollow shaft 2 are constructed of an electrically conductive metal, (for example, stainless steel). The atomizing head 3 and the hollow shaft 2 are typically screw-engaged to each other and are fitted to each other at tapered end-portions of the atomizing head 3. The atomizing head 3 has a bell 38 and a hub 22 transverse to an axis of the atomizing head. The atomizing head 3 has a center bore at the bell 38 and the hollow shaft 2 has an axially extending center bore.

The nozzle assembly 9 is fixed to the body 8 and/or the thrust bearing 5 and is static. The nozzle assembly 9 is disposed coaxially with the hollow shaft 2 and extends through the bore of the hollow shaft 2 and the bore of the atomizing head 3 so that one end of the nozzle assembly 9 is opposed to the hub 22 of the atomizing head 3. The nozzle assembly 9 selectively supplies a paint and a washing solvent (i.e., thinner) into the atomizing head 3. The nozzle assembly 9 includes a plurality of paint supply nozzles (hereinafter, paint nozzles) 14, 15, 16 (seen in FIGS. 2 and 3) for supplying paints of different colors arranged in parallel with each other, and a washing solvent supply nozzle (hereinafter, a solvent nozzle) 17 for supplying solvent or thinner for washing the atomizing head 3 and the outside surfaces of the ends of the paint nozzles 14, 15 and 16. The paint nozzles 14, 15 and 16 and the solvent nozzle 17 are preferably constructed of metal, (for example, stainless steel). The paint nozzles 14, 15 and 16 are separate from each other and are independent of each other as respective paint paths. The paint nozzles 14, 15 and 16 communicate with paint sources 33, 34 and 35, respectively, of different paint colors, which are also separate from each other.

Figure 3:
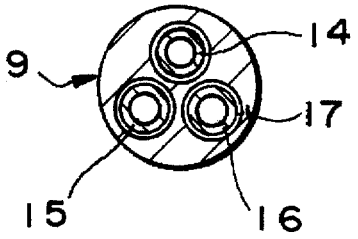
FIG. 3 is an enlarged transverse cross-sectional view of the end of the nozzle assembly of FIG. 2 taken along line 3—3.

Between two and ten paint nozzles may be ideally provided. FIG. 3 illustrates an apparatus which has three paint nozzles arranged on a common circle. As another embodiment, seven paint nozzles may be provided, for example, where one paint nozzle is provided on the axis of the apparatus 1 and the remaining six paint nozzles are arranged about the axis of the apparatus 1 at equi-intervals. The diameters of the paint nozzles may be equal to each other as shown in FIG. 3, or may differ in accordance with the viscosities (usually, 30–300 centi-poise) of the paints which pass through the respective paint nozzles.

Figure 2:
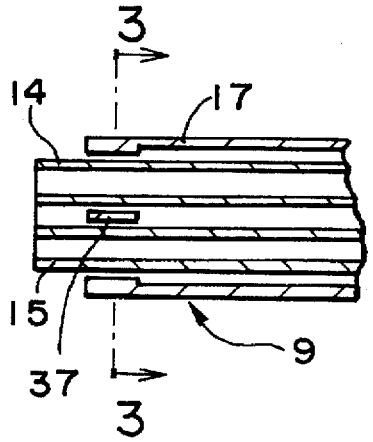
FIG. 2 is an enlarged cross-sectional view of a nozzle assembly of the apparatus of FIG. 1.

As shown in FIGS. 2 and 3, the solvent nozzle 17 has an end plate 37 at a downstream end thereof. The end plate 37 has the same number of apertures as the number of the paint nozzles. Each paint nozzle 14, 15, 16 extends through a respective aperture formed in the end plate 37 with a clearance held between the aperture and the outside surface of the paint nozzle. The clearance allows solvent or thinner to flow therethrough when the painting color is changed. A positioning plate (not shown) is provided within the solvent nozzle 17 adjacent to the end plate 37 to prevent the paint nozzles from vibrating and also has a plurality of apertures to allow the solvent to flow therethrough.

The paint nozzles 14, 15 and 16 have downstream ends which protrude from a downstream end of the solvent nozzle 17 by about 0.5 mm–10 mm. If the paint nozzles are recessed within the end of the solvent nozzle or if the protrusion amount of the paint nozzles from the solvent nozzle is smaller than about 0.5 mm, the flow of the solvent through the clearance between the paint nozzle and the solvent nozzle might be disturbed. If the protrusion of the paint nozzles from the solvent nozzle is greater than 10 mm, the paint nozzles might be too close to the hub 22 of the atomizing head 3 or might interfere with the hub 22.

As illustrated in FIG. 1, the hub 22 of the atomizing head 3 is positioned ahead of the nozzle assembly 9. The hub 22 has a central portion protruding toward the nozzle assembly 9. The central portion has a form of a cone so that the paint supplied against the cone-shaped portion smoothly changes its flow direction to a radially outward direction. The hub 22 has a plurality of first apertures 24 at a radially outward portion of the hub, which are porvided at equi-intervals and which extend in a direction along the inside surface of the bell 38. The first apertures 24 have a diameter which allows a paint to pass smoothly therethrough. The hub 22 also has a plurality of second apertures 23 at a central, cone-shaped portion thereof. Each second aperture 23 is inclined with respect to the axis of the atomizing head 3 so that the paint injected from a given paint nozzle parallel to the axis of the atomizing head 3 does not pass straight through the second aperture in the form of a thread. Each second aperture 23 has a smaller diameter than that of a first aperture 24 so that primarily the solvent, which has a lower viscosity than paint, can easily pass through the second aperture 23 when solvent is supplied to the atomizing head 3.

The electrostatic high voltage generating device 7 is housed in the body 8. The generating device 7 is electrically connected to a low voltage electric power source 36 and generates electricity of a high voltage (for example, about 60–90 KV) at a high frequency (for example, about 3 KHz). The electricity is conducted through metal members of the apparatus (for example, the paint spray shaping air injection device 6, the bearings 4 and/or 5, and the hollow shaft 2) to the atomizing head 3. The paint flowing along the surface of the atomizing head 3 is electrified with negative ions and is dispersed into fine drops at the end of rotating atomizing head 3 due to the centrifugal force acting on the paint. The fine paint drops are further atomized due to electrical repulsion. The atomized drops are electrically attracted toward an workpiece to be painted (for example, an automobile body) which is positively electrified.

The paint spray shaping air injection device 6 has a nozzle for injecting air for controlling the spray pattern of scattering paint drops. The injected air also promotes atomization of the paint drops.

Figure 4:
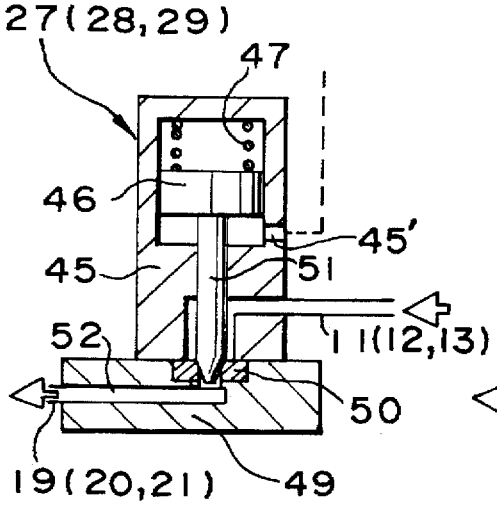
FIG. 4 is an enlarged cross-sectional view of a paint valve used in the apparatus in accordance with the first embodiment of the invention.

AS illustrated in FIGS. 1 and 4, the coating apparatus further includes a plurality of paint valves 27, 28 and 29, a solvent valve 26, a plurality of paint sources 33, 34 and 35, a solvent source 32, a plurality of paint passage 19, 20 and 21, a solvent passage 18, a plurality of paint hoses 11, 12 and 13, and a solvent hose 10. The paint sources 33, 34 and 35 have respective paint colors different from each other. The number of paint valves is the same as the number of the paint nozzles. Each paint passage 19, 20, 21 connects a respective paint nozzle 14, 15, 16 to a respective paint valve 27, 28, 29, respectively. The solvent passage 18 connects the solvent nozzle 17 to the solvent valve 26. Similarly, each paint hose 11, 12, 13 connects a respective paint valve 27, 28, 29 to a respective paint source 33, 34, 35, respectively. The solvent hose 10 connects the solvent valve 26 to the solvent source 32 via a solvent pump 48. The solvent valve 26 may also have a port which is connected to a washing air source 54. By feeding not only a solvent, but also air, the paint washing effect is increased and the washing period is decreased.

Each paint valve 27, 28, 29 may, for example, be an air-actuated ON/OFF valve as illustrated in FIG. 4 which comprises a valve body 49 having a paint hole 52 (connected to the paint passage 19, 20, 21 and the paint hose 11, 12, 13), a valve seat 50, a cylinder 45 fixed to the valve body 49, a piston 46 slidably disposed within the cylinder 45, a piston-rod 51 coupled to the piston 46, and a spring 47 for biasing the piston 46 toward the valve seat 50. When pressurized air is charged to the piston 46 from an air inlet 45', the piston 46 is moved in a direction away from the valve seat 50 to open the paint hole 52 and to allow the paint to flow into the paint passage 19, 20, 21. The paint valves 27, 28 and 29 are operated independently of each other. The solvent valve 26 also comprises an air-actuated ON/OFF valve which may have two ON/OFF portions (one for solvent and another for air) each having the same structure and general operation as that of the paint valve.

In each paint hose 11, 12, 13, a gear pump 39, 40, 41 and/or an air-actuated flow regulator 42, 43, 44 are installed. There may also be a return hose (not shown) for returning excess paint from the regulator to the paint source.

The paint paths from the paint sources 33, 34, and 35 to the downstream ends of the paint nozzles 14, 15, and 16 are separate from each other, so they do not communicate with each other as a path. The solvent path from the solvent source 32 to the downstream end of the solvent nozzle 17 is separate from the paint paths, so it does not communicate with the paint paths.

In a case where a number of paints having different colors to be changed exceeds the number of the paint nozzles, a conventional manifold and color change valve assembly may be connected to any one of the paint hoses 11, 12 and 13.

The operation (method of use) of the coating apparatus of the present invention will now be explained.

When a paint color is changed, the currently operating corresponding paint valve (for example, valve 27) is closed so that the supply of any paint to the atomizing head 3 is stopped. Then, the solvent valve 26 is opened so that a washing solvent is supplied to the atomizing head 3 through the clearances between the paint nozzles 14, 15 and 16 and the end plate 37 of the solvent nozzle 17. The supplied solvent washes away paint adhering to the inside surface of the bell 38 of the atomizing head 3, the inside and outside surfaces of the hub 23 of the atomizing head 3, and the outside surfaces of the end portions of the paint nozzles 14, 15 and 16 which protrude from the solvent nozzle 17. Since the solvent, (for example, thinner), has a relatively low viscosity, the solvent can pass through the second apertures 23 formed in the central portion of the hub 22 and can wash the outside surface of the hub 22. During the washing, the atomizing head 3 is rotated.

Unlike the conventional coating apparatus, the internal portions of the currently operating paint nozzle 14 and the paint passage 19 connected to the currently operating paint nozzle 14 are not washed by the solvent. Thus, the paint filling the currently operating paint nozzle 14 and the corresponding paint passage 19 is not wasted. The paint which is washed out is therefore only the paint adhering to the atomizing head 3 and the end portion of the paint nozzle 14. As a result, the amount of the paint wasted when one paint is changed to another is substantially decreased. Also, the amount of the washing solvent consumed when the paint color is changed is greatly decreased. When the washing is completed, the solvent valve 26 is closed.

After the washing, another paint valve (for example, valve 28) is opened so that a desired paint having a color different from the previous paint is supplied and the next painting process starts. Because the atomizing head 3 has been washed, unwanted mixing of paints having different colors does not occur.

Since a plurality of paint nozzles are provided, and each paint nozzle is uniquely connected to a respective paint source, the paint filling a given paint nozzle and paint passage connected thereto does not need to be washed, so that the amount of the paint wasted when changing a paint color is decreased to substantially zero. The amount of the washing solvent used is also greatly decreased. Decreasing the amount of wasted paint and consumed solvent is additionally desirable from the viewpoint of preserving the good and healthful environmetal conditions.

A second embodiment of the invention will now be explained. The second embodiment aims to prevent a paint from dripping out from an end of a paint nozzle after the paint valve communicating with the paint nozzle is closed before changing paint colors. The second embodiment is different from the first embodiment only in the structure of a paint valve.

Figure 5:
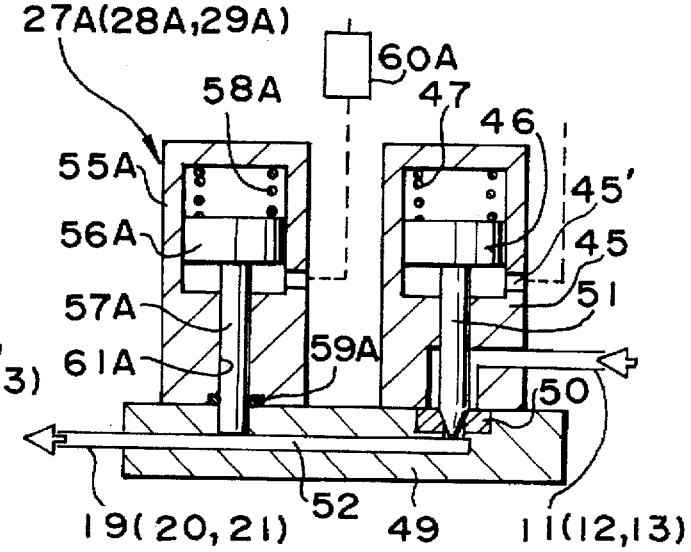
FIG. 5 is an enlarged cross-sectional view of a paint valve used in the apparatus in accordance with the second embodiment of the present invention.

As illustrated in FIG. 5, the paint valve 27A, 28A, 29A used in the second embodiment of the invention is an air-actuated ON/OFF valve which comprises a valve body 49 having a paint flow hole 52 formed therein and having a valve seat 50, a paint flow ON/OFF portion for allowing or stopping a paint to flow through the paint flow hole 52, and a paint suction portion, located downstream of the paint flow ON/OFF portion, for suctioning a paint which has passed through the paint flow ON/OFF portion when operated after the paint flow ON/OFF portion has stopped the paint flow.

The paint suction portion comprises a piston-rod hole 61A in communication with the paint flow hole 52, a cylinder 55A coupled to the valve body 49, a piston 56A slidably disposed within the cylinder 55A, a piston-rod 57A coupled to the piston 56A and slidably inserted in the piston-rod hole 61A, and a seal member 59A for forming a seal between the piston-rod 57A and a surface of the piston-rod hole 61A. A first chamber and a second chamber are defined on opposite sides of the piston 56A in the cylinder 55A. A spring 58A is housed in the first chamber and biases the piston 55A toward the paint flow hole 52. A pressurized-air circuit is connected to the second chamber via a speed control valve 60A which controls a supply speed of the pressurized air supplied. The piston-rod hole 61A has a diameter of about 2–6 mm so that a paint recedes about 5–100 mm from the end of the paint nozzle when the piston-rod 57A is moved away from the paint flow hole 52. Thus, excess paint cannot form into droplets at the paint nozzle.

The paint flow ON/OFF portion has the same structure as that of the paint valve of the first embodiment of the invention. More particularly, the paint flow ON/OFF portion has a cylinder 45, a piston 46 slidably disposed within the cylinder 45, a piston-rod 51 coupled to the piston 46 and having a needle valve on an end thereof, and a spring 47 biasing the piston and piston-rod toward the valve seat 50. When pressurized air is introduced into a chamber defined on one side of the piston 46, the piston 46 is moved away from the valve seat 50 to open the paint hole 52.

When a paint color is changed, supply of actuating (pressurized) air to the paint flow ON/OFF portion of a currently operating paint valve (for example, 27A) is stopped so that the needle valve or piston-rod 51 closes the paint flow path 52. Then, actuating pressurized air is introduced to the second chamber of the paint suction portion of the paint valve 27A so that the piston 56A and the piston-rod 57A are moved away from the paint flow hole 52 and the paint filling the corresponding paint nozzle 14 is suctioned to recede from the end of the paint nozzle 14 by a distance of about 5–100 mm. Then, supply of an actuating air to the paint suction portion of a second paint valve (for example, 28A) is stopped and the piston-rod 57A of the paint valve 28A is moved toward the paint flow hole 52 so that the piston-rod 57A can be moved away from the hole 52 during a subsequent paint color change. Then, the spray gun is washed by solvent in the manner discussed with reference to the first embodiment. Then, the paint flow ON/OFF portion of the second paint valve 28A is opened so that a new painting process starts.

In accordance with the second embodiment of the invention, mixing of paint colors when paints are changed is assuredly prevented. Therefore, a spray gun of the second embodiment can be coupled to an arm of a robot which can take an arbitrary posture.

A third embodiment of the invention will now be explained. The third embodiment aims to suppress electrostatic charge leakage (through a paint toward the paint source) in the electrostatic coating process. The third embodiment is different from the first embodiment only according to its paint electrifying structure.

Figure 6:
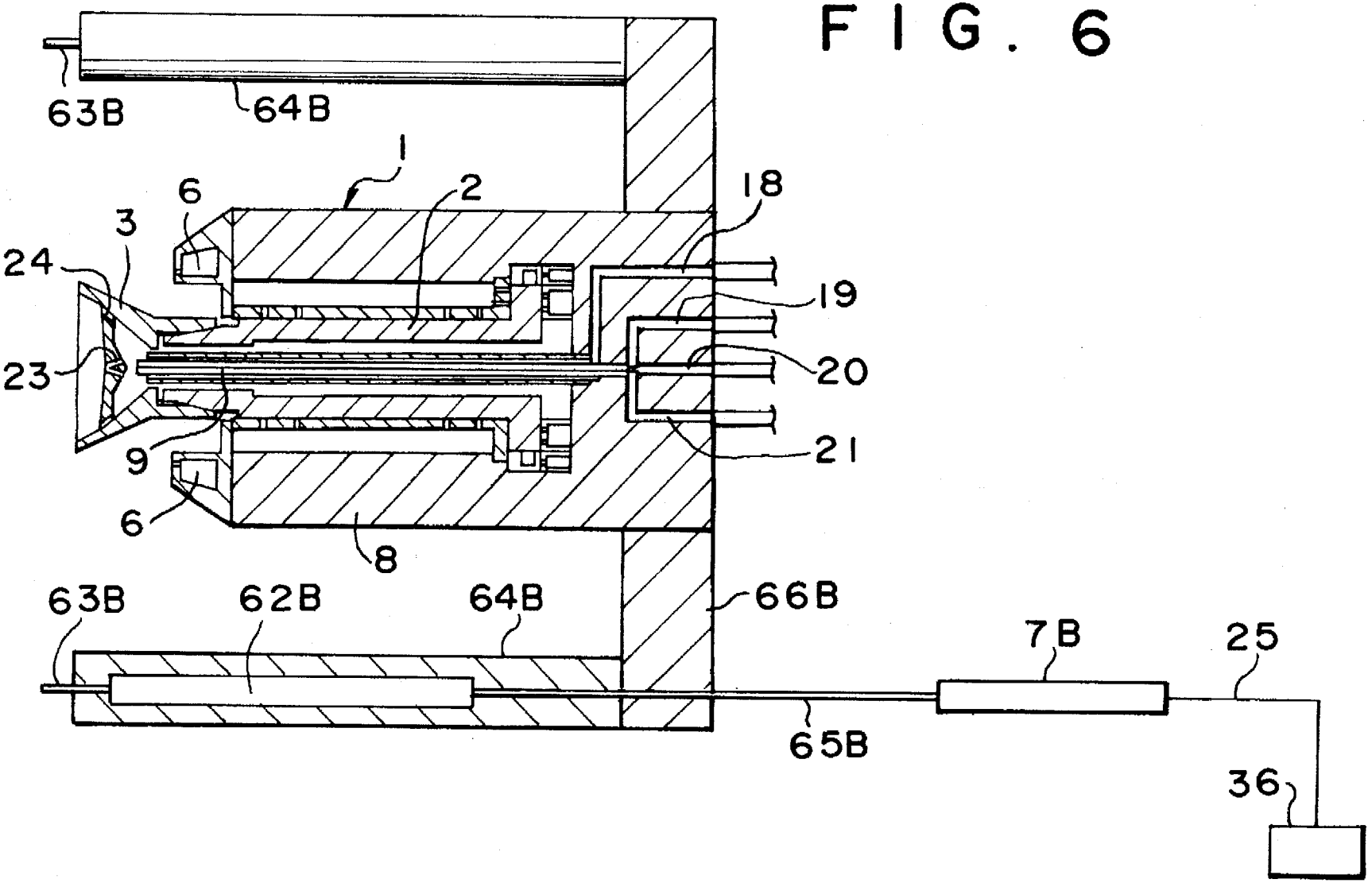
FIG. 6 is a partial cross-sectional view of a rotary atomizing electrostatic coating apparatus in accordance with a third embodiment of the present invention.
Figure 7:
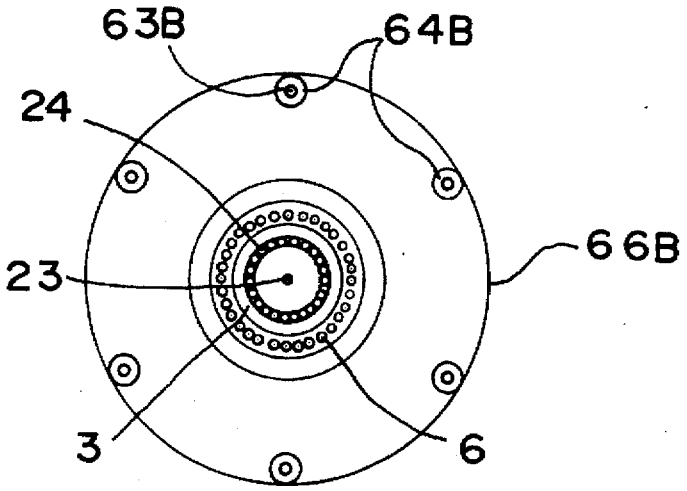
FIG. 7 is a front view of the apparatus of FIG. 6.

As illustrated in FIGS. 6 and 7, a plurality of (for example, six, as shown in FIG. 7) outside electrodes 64B are provided and are coupled via a flange portion 66B to the static body 8. The outside electrodes 64B have electrode pins 63B which protrude outside from the electrodes 64B and are arranged radially outside of the atomizing head 3 at equi-intervals about the axis of the body 8 so that the electrode pins 63B can electrify the paint droplets sprayed from the edge of the rotating atomizing head 3. The outside electrodes 64B have electrically insulating pillars in which electrostatic safety resistors 62B are embedded. The electrostatic resistors 62B are connected via a high voltage cable 65B to an electrostatic high voltage generating device 7B (corresponding to the device 7 of the first embodiment) which is located apart from the static body 8. The device 7B is connected via a cable 25 to a low voltage power source 36.

In the apparatus according to the present invention, fine paint drops sprayed from the rotating atomizing head 3 are electrostatically charged substantially without causing electric leakage through paint to the paint source, even if a highly electrically conductive paint is used.

A fourth embodiment of the invention will now be explained. The fourth embodiment aims to provide an apparatus wherein the number of paint nozzles can be increased so that the number of changeable colors is increased. The fourth embodiment is different from the first embodiment in its paint nozzle and paint valve structure only.

Figure 8:
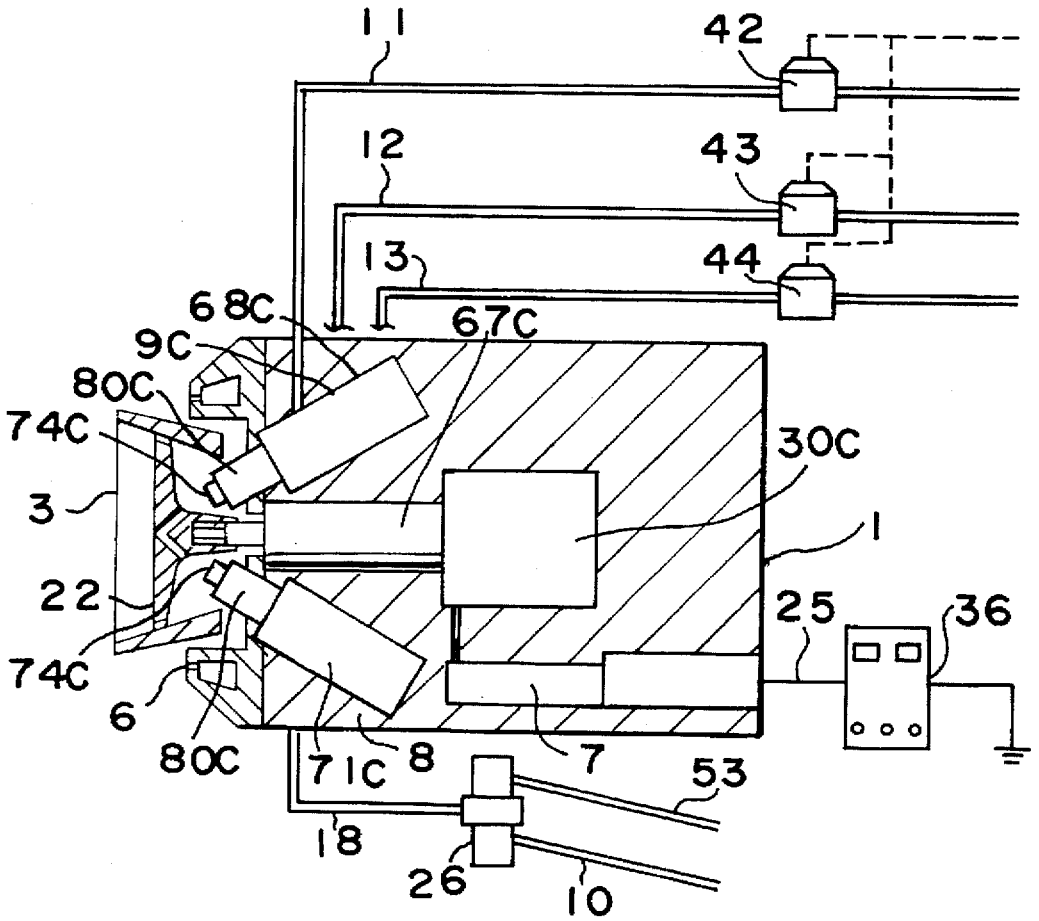
FIG. 8 is a partial cross-sectional view of a rotary atomizing electrostatic coating apparatus in accordance with a fourth embodiment of the present invention.
Figure 9:
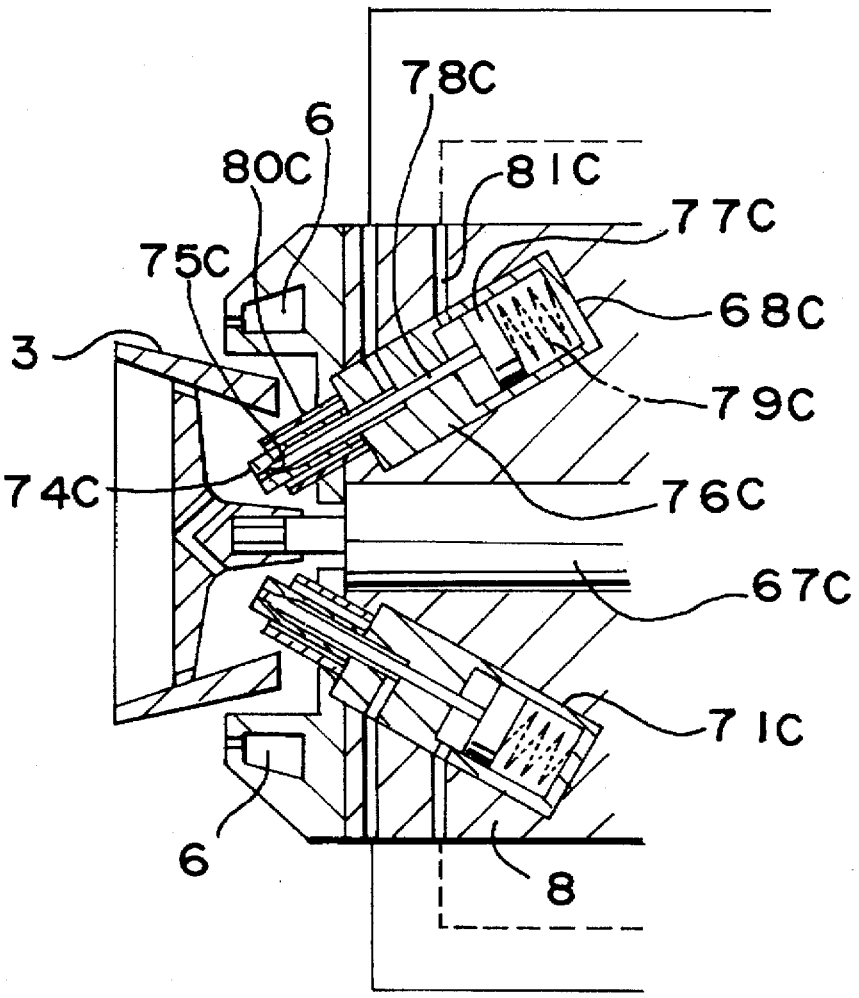
FIG. 9 is a partial, enlarged cross-sectional view of the apparatus of FIG. 8.
Figure 10:
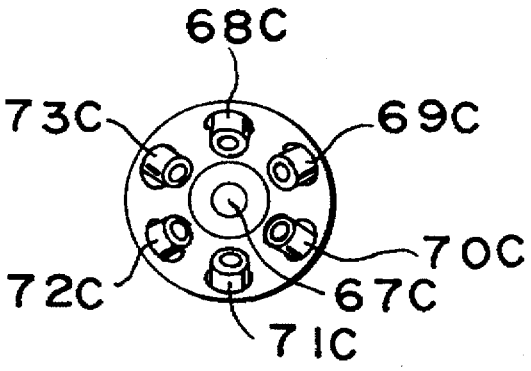
FIG. 10 is a partial plan view of a nozzle assembly of the apparatus of FIG. 9.

As illustrated in FIGS. 8, 9 and 10,an air motor 30C has a drive shaft 67C to which the atomizing head 3 is directly connected. The drive shaft 67C may be the hollow shaft 2 of the first embodiment of the invention.

The nozzle assembly 9C includes a plurality of paint nozzles having a valve structure 68C, 69C, 70C, 71C, 72C, 73C which correspond to the assembly of the paint nozzles and the paint valves of the first embodiment. The paint nozzles having a valve structure are arranged about and are radially spaced from the drive shaft 67C of the air motor 30C. Each paint nozzle has a paint nozzle 74C having a valve seat 75C formed in the downstream end of the paint nozzle 74C, a needle valve 78C disposed within the paint nozzle 74C and movable towards and away from the valve seat 75C, a cylinder 76C, a piston 77C slidably disposed within the cylinder 76C to define a first chamber and a second chamber on opposite sides thereof and coupled to the needle valve 78C, a spring 79C inserted in the first chamber to bias the piston 77C and the needle valve 78C toward the valve seat 75C, and an air circuit 81C connected to the second chamber for introducing a pressurized air into the second chamber.

An identical number of solvent nozzles 80C as the number of the paint nozzles is provided. Each paint nozzle 74C is disposed within each solvent nozzle 80C. Each paint nozzle 74C protrudes from an end of the corresponding solvent nozzle 80C as with the first embodiment. Each paint nozzle is inwardly angled with respect to the axis of the static body 8 in a direction toward the atomizing head 3.

In the fourth embodiment of the invention, since the paint nozzles 74C are arranged radially outside the shaft 67C of the air motor 30C, the number of the paint nozzles 74C which can be provided can be increased compared with the first embodiment where all the paint nozzles are disposed in the single hollow shaft. Further, since each paint nozzle is closed at a downstream end thereof by the valve structure therein, the dripping of paint from the paint nozzle is prevented. Such a spray gun may be coupled to an arm of a painting robot and allowed to take an arbitrary posture without concern about paint dripping. Furthermore, since the distance between the paint nozzle and the paint valve is much shorter compared to the first embodiment, a response time for starting and stopping a painting process is very quick.

Although only four embodiments of the invention have been described in detail above, it will be appreciated by those skilled in the art that various modifications and alterations can be made to the particular embodiments described here without materially departing from the novel teachings and advantages of the present invention. Accordingly, it is to be understood that all such modifications and alterations are included within the spirit and scope of the present invention as defined by the following claims.

What is claimed is:

1. A rotary atomizing electrostatic coating apparatus comprising:

(a) a static body having an axis therealong;

(b) an atomizing head rotatable about the axis of the static body;

(c) driving means for rotatably driving the atomizing head including a drive shaft coupled to said atomizing head; and (d) a static nozzle assembly coupled to said static body and opposite said atomizing head, including an equal number of paint nozzles and solvent nozzles, each said paint nozzle being disposed within a respective solvent nozzle and supplying a particular paint to said atomizing head, wherein said plurality of paint nozzles includes a valve structure corresponding to each said paint nozzle, said valve structure being arranged about and radially spaced from said drive shaft, wherein each said paint nozzle further comprises:

(1) a valve seat formed adjacent a downstream end of the paint nozzle;

(2) a needle valve disposed within the paint nozzle and sealingly engageable with the valve seat;

(3) a cylinder;

(4) a piston slidably disposed within the cylinder and defining a first chamber and a second chamber within the cylinder on opposite sides thereof, said piston being coupled to the needle valve;

(5) a spring disposed in the first chamber to bias the piston and the needle valve towards a sealing engagement with the valve seat; and (6) an air circuit connected to the second chamber of the cylinder for introducing pressurized air in the second chamber.

2. A rotary atomizing electrostatic coating apparatus comprising:

(a) a static body having an axis therealong;

(b) an atomizing head rotatable about said axis of said static body;

(c) driving means for rotatably driving said atomizing head; and (d) a static nozzle assembly coupled to said static body and opposite from said atomizing head, including a plurality of paint nozzles and one solvent nozzle, each said paint nozzle supplying a particular paint to said atomizing head, wherein said plurality of paint nozzles are arranged within and extend through said one solvent nozzle.

3. An apparatus according to claim 2, wherein between two and ten paint nozzles are provided.

4. An apparatus according to claim 2, wherein each paint nozzle of said plurality of paint nozzles has an end protruding by a fixed distance from said one solvent nozzle.

5. An apparatus according to claim 4, wherein said fixed distance is between about 0.5–10 mm.

6. An apparatus according to claim 2, wherein said atomizing head comprises a bell having an axis and a hub disposed within said bell in a plane perpendicular to said axis of said bell, wherein said hub has a central portion and a peripheral portion radially distal to said central portion, said hub including:

a protruding portion provided at said central portion opposite said nozzle assembly, a plurality of first apertures formed through said hub at said peripheral portion of said hub for allowing a paint from said nozzle assembly to pass therethrough, and a plurality of second apertures formed through said hub adjacent said central portion of said hub for allowing a solvent to pass therethrough, wherein each said second aperture is angled with respect to said axis of said bell so that said second apertures converge toward said axis of said atomizing head along a direction away from said nozzle assembly.

7. An apparatus according to claim 2, further comprising:

an electrostatic high voltage generating device electrically connected with said atomizing head; and a paint-spray shaping air injection device coupled to said static body for shaping a spray pattern of a paint sprayed from one of said paint nozzles.

8. An apparatus according to claim 2, further comprising a plurality of paint valves, each said paint valve corresponding to and fluidly communicating with a respective paint nozzle.

9. An apparatus according to claim 2, further comprising at least one solvent valve corresponding to and fluidly communicating with said one solvent nozzle.

10. An apparatus according to claim 2, further comprising:

a plurality of paint valves, each said paint valve corresponding to a respective paint nozzle, and at least one solvent valve, said at least one solvent valve corresponding to said one solvent nozzle;

a plurality of paint sources, each said paint source corresponding to a respective paint nozzle, each said paint source having a unique paint relative to the other paint sources, and a solvent source;

a plurality of paint passages, each said paint passage corresponding to a respective paint nozzle, and at least one solvent passage, said at least one solvent passage corresponding to said one solvent nozzle, each said paint passage connecting a paint nozzle to a respective paint valve and said at least one solvent passage connecting said one solvent nozzle to said at least one solvent valve; and a plurality of paint hoses and at least one solvent hose, each said paint hose connecting a respective paint valve to a respective paint source and each said solvent hose connecting said at least one solvent valve to said solvent source.

11. An apparatus according to claim 10, wherein each said paint hose includes a regulator and a gear pump.

12. An apparatus according to claim 2, further comprising a hollow shaft rotatably disposed within said static body so as to be rotatably driveable by said driving means, wherein said atomizing head is fixedly coupled to said hollow shaft so as to rotate together with said hollow shaft.

13. An apparatus according to claim 12, wherein said driving means rotatably drives said hollow shaft having said atomizing head coupled thereto.

14. An apparatus according to claim 2, wherein said one solvent nozzle has an end plate having as many apertures formed therethrough as the number of said paint nozzles provided, each said paint nozzle extending through a respective aperture with a clearance therebetween for allowing solvent to pass through.

15. An apparatus according to claim 12, wherein said driving means for rotating said hollow shaft comprises a plurality of turbine blades fixedly mounted on a peripheral surface of said hollow shaft and a plurality of air injection nozzles provided in said static body for blowing air from a pressurized air source against the turbine blades to cause said hollow shaft to rotate.

16. An apparatus according to claim 2, further comprising a plurality of paint valves, each paint valve corresponding to and fluidly communicating with a corresponding one of said paint nozzles, and wherein each paint valve comprises an air-actuated ON/OFF valve.

17. An apparatus according to claim 2, further comprising a solvent valve corresponding to said one solvent nozzle, wherein said solvent valve is an air-actuated ON/OFF valve.

18. An apparatus according to claim 2, further comprising a plurality of paint valves, one said paint valve corresponding to and fluidly communicating with a respective one of said paint nozzles, each said paint valve comprising:

a valve body having a paint flow hole formed therein, said paint flow hole being connected with one of said paint nozzles;

a paint flow ON/OFF portion for selectively preventing a paint from flowing through said paint flow hole; and a paint suction portion, located downstream of said paint flow ON/OFF portion, for suctioning paint in said paint flow hole between said nozzle and said paint flow ON/OFF portion after said paint flow ON/OFF portion is operated to prevent paint flow.

19. An apparatus according to claim 18, wherein said paint suction portion comprises:

a piston-rod hole in communication with the paint flow hole;

a cylinder;

a piston slidably disposed within said cylinder; and a piston-rod coupled to said piston and slidably disposed within said piston-rod hole.

20. An apparatus according to claim 19, wherein said cylinder of said paint suction portion has a first chamber and a second chamber on opposite sides of said piston, an expansible spring being housed in said first chamber to bias said piston and said piston-rod in a direction toward said paint flow hole, a pressurized air circuit being connected to said second chamber.

21. An apparatus according to claim 19, wherein a diameter said piston-rod is about 2–6 mm.

22. An apparatus according to claim 18, wherein said paint flow ON/OFF portion comprises:

a cylinder;

a valve seat formed adjacent to a junction between said cylinder and said paint flow hole;

a needle valve movable toward and away from a sealing engagement with said valve seat; and a piston slidably disposed within said cylinder and coupled with said needle valve.

23. An apparatus according to claim 2, further comprising:

a plurality of electrode pins arranged radially outside of and spaced from said atomizing head; and an electrostatic high voltage generating device spatially separated from said static body and electrically connected with said plurality of electrode pins.

24. An apparatus according to claim 23, wherein said plurality of electrode pins are arranged at equi-intervals on a circle about an axis of said static body.

25. A rotary atomizing electrostatic coating apparatus comprising:

(a) a static body having an axis therealong;

(b) an atomizing head rotatable about said axis of said static body;

(c) driving means for rotatably driving said atomizing head;

(d) a static nozzle assembly coupled to said static body and opposite from said atomizing head, including a plurality of paint nozzles and at least one solvent nozzle, each said paint nozzle supplying a particular paint to said atomizing head; and (e) a plurality of paint valves, each said paint valve corresponding to and fluidly communicating with a respective one of said paint nozzles, each said paint valve comprising:

a valve body having a paint flow hole formed therein, said paint flow hole being connected with one of said paint nozzles;

a paint flow ON/OFF portion for selectively preventing a paint from flowing through said paint flow hole; and a paint suction portion, located downstream of said paint flow ON/OFF portion, for suctioning paint in said paint flow hole between said nozzle and said paint flow ON/OFF portion after said paint flow ON/OFF portion is operated to prevent paint flow.

26. An apparatus according to claim 25, wherein between two and ten paint nozzles are provided.

27. An apparatus according to claim 25, wherein each said paint nozzle extends about 0.5–10 mm farther than said at least one solvent nozzle.

28. An apparatus according to claim 25, wherein said atomizing head comprises a bell having an axis and a hub disposed within said bell in a plane perpendicular to said axis of said bell, wherein said hub has a central portion and a peripheral portion radially distal to said central portion, said hub including:

a protruding portion provided at said central portion opposite said nozzle assembly, a plurality of first apertures formed through said hub at said peripheral portion of said hub for allowing a paint from said nozzle assembly to pass therethrough, and a plurality of second apertures formed through said hub adjacent said central portion of said hub for allowing a solvent to pass therethrough, wherein each said second aperture is angled with respect to said axis of said bell so that said apertures converge toward said axis of said atomizing head along a direction away from said nozzle assembly.

29. An apparatus according to claim 25, further comprising:

an electrostatic high voltage generating device electrically connected with said atomizing head; and a paint-spray shaping air injection device coupled to said static body for shaping a spray pattern of a paint sprayed from one of said paint nozzles.

30. An apparatus according to claim 25, further comprising a plurality of paint valves, each said paint valve corresponding to and fluidly communicating with a respective paint nozzle.

31. An apparatus according to claim 25, further comprising at least one solvent valve corresponding to and fluidly communicating with said at least one solvent nozzle.

32. An apparatus according to claim 25, further comprising:

at least one solvent valve, said at least one solvent valve corresponding to said at least one solvent nozzle;

a plurality of paint sources, each said paint source corresponding to a respective paint nozzle, each said paint source having a unique paint relative to other paint sources, and a solvent source;

a plurality of paint passages, each said paint passage corresponding to a respective paint nozzle, and at least one solvent passage, said at least one solvent passage corresponding to said at least one solvent nozzle, each said paint passage connecting a paint nozzle to a respective paint valve and each said solvent passage connecting said at least one solvent nozzle to said at least one solvent valve; and a plurality of paint hoses and at least one solvent hose, each said paint hose connecting a respective said paint valve to a respective said paint source and each said solvent hose connecting a respective said solvent valve to said solvent source.

33. An apparatus according to claim 32, wherein each said paint hose includes a regulator and a gear pump.

34. An apparatus according to claim 25, and further comprising a hollow shaft rotatably disposed within said static body so as to be rotatably driveable by said driving means, wherein said atomizing head is fixedly coupled to said hollow shaft so as to rotate together with said hollow shaft.

35. An apparatus according to claim 34, wherein said driving means rotatably drives said hollow shaft having said atomizing had coupled thereto.

36. An apparatus according to claim 34, wherein one solvent nozzle is provided, and wherein said paint nozzles are arranged within and extend through said one solvent nozzle.

37. An apparatus according to claim 36, wherein said solvent nozzle has an end plate having as many apertures formed therethrough as the number of paint nozzles provided, each said paint nozzle extending through a respective aperture with a clearance therebetween for allowing solvent to pass through.

38. An apparatus according to claim 34, wherein said driving means for rotating said hollow shaft comprises a plurality of turbine blades fixedly mounted on a peripheral surface of said hollow shaft and a plurality of air injection nozzles provided in said static body for blowing air from a pressurized air source against the turbine blades to cause said hollow shaft to rotate.

39. An apparatus according to claim 36, wherein each said paint valve comprises an air-actuated ON/OFF valve.

40. An apparatus according to claim 36, further comprising a solvent valve corresponding to said one solvent nozzle, wherein said solvent valve is an air-actuated ON/OFF valve.

41. An apparatus according to claim 25, wherein said paint suction portion comprises:

a piston-rod hole in communication with said paint flow hole;

a cylinder;

a piston slidably disposed within said cylinder; and a piston-rod coupled to said piston and slidably disposed within said piston-rod hole.

42. An apparatus according to claim 41, wherein said cylinder of said paint suction portion has a first chamber and a second chamber on opposite sides of said piston, an expansible spring being housed in said first chamber to bias said piston and said piston-rod in a direction toward said paint flow hole, a pressurized air circuit being connected to said second chamber.

43. An apparatus according to claim 41, wherein a diameter of said piston-rod is about 2–6 mm.

44. An apparatus according to claim 25, wherein said paint flow ON/OFF portion comprises:

a cylinder;

a valve seat formed adjacent to a junction between said cylinder and said paint flow hole;

a needle valve which is movable toward and away from a sealing engagement with said valve seat; and a piston slidably disposed within said cylinder and coupled with said needle valve.

45. An apparatus according to claim 25, further comprising:

a plurality of electrode pins arranged radially outside and spaced from said atomizing head; and an electrostatic high voltage generating device spatially separated from said static body and electrically connected with said plurality of electrode pins.

46. An apparatus according to claim 45, wherein said plurality of electrode pins are arranged at equi-intervals on a circle about an axis of said static body.

47. An apparatus according to claim 25, wherein said drive assembly has a drive shaft which is coupled to said atomizing head.

48. An apparatus according to claim 47, wherein said plurality of paint nozzles are arranged about and radially spaced from said drive shaft of said drive assembly.

49. An apparatus according to claim 48, wherein each said paint nozzle further comprises:

a valve seat formed adjacent to a downstream end of said paint nozzle;

a needle valve disposed within said paint nozzle and sealingly engageable with said valve seat;

a cylinder;

a piston slidably disposed within said cylinder and defining a first chamber and a second chamber within said cylinder on opposite sides of said piston, said piston being coupled to said needle valve;

a spring disposed in said first chamber to bias said piston and said needle valve toward a sealing engagement with said valve seat; and an air circuit connected to said second chamber of said cylinder for introducing pressurized air into said second chamber.

50. An apparatus according to claim 49, wherein an identical number of solvent nozzles and paint nozzles are provided, wherein each said paint nozzle is disposed within a respective said solvent nozzle.

51. An apparatus according to claim 47, wherein each of said paint nozzles is angled toward the axis of said static body with respect to a direction toward said atomizing head and away from said static body.

52. A rotary atomizing electrostatic coating apparatus comprising:

(a) a static body having an axis therealong;

(b) an atomizing head rotatable about said axis of said static body;

(c) driving means for rotatably driving said atomizing head; and (d) a static nozzle assembly coupled to said static body and opposite from said atomizing head, including a plurality of paint nozzles and a plurality of solvent nozzles, wherein an identical number of solvent nozzles and paint nozzles are provided, wherein each said paint nozzle is provided within a respective said solvent nozzle, each said paint nozzle supplying a particular paint to said atomizing head.

53. An apparatus according to claim 52, wherein between two and ten paint nozzles are provided.

54. An apparatus according to claim 52, wherein each said paint nozzle extends about 0.5–10 mm farther than a corresponding said solvent nozzle.

55. An apparatus according to claim 52, wherein said atomizing head comprises a bell having an axis and a hub disposed within said bell in a plane perpendicular to said axis of said bell, wherein said hub has a central portion and a peripheral portion radially distal to said central portion, said hub including:

a protruding portion provided at said central portion opposite said nozzle assembly, a plurality of first apertures formed through said hub at said peripheral portion of the hub for allowing a paint from said nozzle assembly to pass therethrough, and a plurality of second apertures formed through said hub adjacent said central portion of said hub for allowing a solvent to pass therethrough, wherein each said second aperture is angled with respect to said axis of said bell so that said second apertures converge toward said axis of said atomizing head along a direction away from said nozzle assembly.

56. An apparatus according to claim 52, further comprising:

an electrostatic high voltage generating device electrically connected with said atomizing head; and a paint-spray shaping air injection device coupled to said static body for shaping a spray pattern of a paint sprayed from one of the paint nozzles.

57. An apparatus according to claim 52, further comprising a plurality of paint valves, each said paint valve corresponding to and fluidly communicating with a respective said paint nozzle.

58. An apparatus according to claim 52, further comprising at least one solvent valve corresponding to and fluidly communicating with said plurality of solvent nozzles.

59. An apparatus according to claim 52, further comprising:

a plurality of paint valves, each said paint valve corresponding to a respective paint nozzle, and at least one solvent valve, said at least one solvent valve corresponding to said plurality of solvent nozzles;

a plurality of paint sources, each said paint source corresponding to a respective paint nozzle, each said paint source having a unique paint relative to other said paint sources, and a solvent source;

a plurality of paint passages, each said paint passage corresponding to a respective paint nozzle, and at least one solvent passage, said at least one solvent passage corresponding to said plurality of solvent nozzles, each said paint passage connecting a paint nozzle to a respective paint valve and each said solvent passage connecting a solvent nozzle to a respective solvent valve; and a plurality of paint hoses and at least one solvent hose, each said paint hose connecting a respective paint valve to a respective paint source and each said solvent hose connecting a respective solvent valve to said solvent source.

60. An apparatus according to claim 59, wherein each said paint hose includes a regulator and a gear pump.

61. An apparatus according to claim 52, further comprising a hollow shaft rotatably disposed within said static body so as to be rotatably driveable by said driving means, wherein said atomizing head is fixedly coupled to said hollow shaft so as to rotate together with said hollow shaft.

62. An apparatus according to claim 61, wherein said driving means rotatably drives said hollow shaft having said atomizing head coupled thereto.

63. An apparatus according to claim 61, wherein said driving means for rotating said hollow shaft comprises a plurality of turbine blades fixedly mounted on a peripheral surface of said hollow shaft and a plurality of air injection nozzles provided in said static body for blowing air from a pressurized air source against the turbine blades to cause said hollow shaft to rotate.

64. An apparatus according to claim 52, further comprising further comprising a plurality of paint valves, each said paint valve corresponding to and fluidly communicating with a corresponding one of said paint nozzles, and wherein each said paint valve comprises an air-actuated ON/OFF valve.

65. An apparatus according to claim 52, further comprising:

a plurality of paint valves, one said paint valve corresponding to and fluidly communicating with a respective one of said paint nozzles, each said paint valve comprising:

a valve body having a paint flow hole formed therein, said paint flow hole being connected with one of said paint nozzles;

a paint flow ON/OFF portion for selectively preventing a paint from flowing through said paint flow hole; and a paint suction portion, located downstream of said paint flow ON/OFF portion, for suctioning paint in said paint flow hole between said nozzle and said paint flow ON/OFF portion after said paint flow ON/OFF portion is operated to prevent paint flow, wherein said paint suction portion comprises:

a piston-rod hole in communication with the paint flow hole;

a cylinder;

a piston slidably disposed within the cylinder; and a piston-rod coupled to the piston and slidably disposed within the piston-rod hole.

66. An apparatus according to claim 65, wherein said cylinder of said paint suction portion has a first chamber and a second chamber on opposite sides of said piston, an expansible spring being housed in said first chamber to bias said piston and said piston-rod in a direction toward said paint flow hole, a pressurized air circuit being connected to said second chamber.

67. An apparatus according to claim 65, wherein a diameter said piston-rod is about 2–6 mm.

68. An apparatus according to claim 52, further comprising:

a plurality of paint valves, one said paint valve corresponding to and fluidly communicating with a respective one of said paint nozzles, each said paint valve comprising:

a valve body having a paint flow hole formed therein, said paint flow hole being connected with one of said paint nozzles;

a paint flow ON/OFF portion for selectively preventing a paint from flowing through said paint flow hole; and a paint suction portion, located downstream of said paint flow ON/OFF portion, for suctioning paint in said paint flow hole between said nozzle and said paint flow ON/OFF portion after said paint flow ON/OFF portion is operated to prevent paint flow;

wherein said paint flow ON/OFF portion comprises:

a cylinder;

a valve seat formed adjacent to a junction between said cylinder and said paint flow hole;

a needle valve which is movable toward and away from a sealing engagement with said valve seat; and a piston slidably disposed within said cylinder and coupled with said needle valve.

69. An apparatus according to claim 52, further comprising:

a plurality of electrode pins arranged radially outside and spaced from said atomizing head; and an electrostatic high voltage generating device spatially separated from said static body and electrically connected with said plurality of electrode pins.

70. An apparatus according to claim 69, wherein said plurality of electrode pins are arranged at equi-intervals on a circle about an axis of said static body.

71. An apparatus according to claim 52, wherein said drive assembly has a drive shaft which is coupled to said atomizing head.

72. An apparatus according to claim 71, wherein said plurality of paint nozzles includes a valve structure corresponding to each said paint nozzle and is arranged about and radially spaced from said drive shaft of the drive assembly.

73. An apparatus according to claim 71, wherein each of said paint nozzles is angled toward an axis of said static body with respect to a direction toward said atomizing head and away from said static body.

74. A rotary atomizing electrostatic coating apparatus comprising:

a static body having an axis therealong;

an atomizing head rotatable about said axis of said static body;

driving means for rotatably driving said atomizing head; and a static nozzle assembly coupled to said static body and opposite from said atomizing head, including a plurality of paint nozzles and at least one solvent nozzle, each said paint nozzle supplying a particular paint to said atomizing head, wherein said solvent nozzle has an end plate which defines a plurality of apertures therethrough equal in number to said plurality of paint nozzles, each said paint nozzle extending through a respective aperture reserving a clearance therebetween for allowing solvent to pass through.

75. A rotary atomizing electrostatic coating apparatus comprising:

a plurality of paint nozzles; and a plurality of paint valves, one said paint valve corresponding to and fluidly communicating with a respective one of said plurality of paint nozzles, each said paint valve comprising:

a valve body having a paint flow hole formed therein, the paint flow hole being connected with one of said paint nozzles;

a paint flow ON/OFF portion for selectively preventing paint from flowing through said paint flow hole; and a paint suction portion, located downstream of said paint flow ON/OFF portion, for suctioning paint in said paint flow hole between said nozzle and said paint flow ON/OFF portion after said paint flow ON/OFF portion is operated to prevent paint flow, wherein said paint suction portion comprises:

a piston-rod hole in communication with said paint flow hole;

a cylinder;

a piston slidably disposed within said cylinder; and a piston-rod coupled to said piston and slidably disposed within said piston-rod hole.

76. An apparatus according to claim 75, wherein said cylinder of said paint suction portion has a first chamber and a second chamber on opposite sides of said piston, an expansible spring housed in said first chamber so as to bias said piston and said piston-rod in a direction toward said paint flow hole, and a pressurized air circuit connected to said second chamber.

77. An apparatus according to claim 75, wherein a diameter of said piston-rod hole is about 2–6 mm.

78. An apparatus according to claim 75, wherein said paint flow ON/OFF portion comprises:

a cylinder;

a valve seat formed adjacent to a junction between said cylinder and said paint flow hole;

a needle valve which is movable toward and away from a sealing engagement with said valve seat; and a piston slidably disposed within said cylinder and coupled with said needle valve.

* * * * *